US011976454B2

(12) United States Patent
Jurgens et al.

(10) Patent No.: US 11,976,454 B2
(45) **Date of Patent: *May 7, 2024**

(54) TRENCHLESSLY INSTALLED SUBTERRANEAN COLLECTOR DRAIN FOR SURFACE AND SUBSURFACE WATER

(71) Applicant: TRENCHLESS GROUNDWATER MOVERS, LLC, Gloucester, MA (US)

(72) Inventors: John Jurgens, Bothell, WA (US); Larry Kiest, Fort Lauderdale, FL (US); Bruce Tobey, Gloucester, MA (US)

(73) Assignee: TRENCHLESS GROUNDWATER MOVERS, LLC, Gloucester, MA (US)

( * ) Notice: Subject to any disclaimer, the term of this patent is extended or adjusted under 35 U.S.C. 154(b) by 41 days.

This patent is subject to a terminal disclaimer.

(21) Appl. No.: 17/349,420

(22) Filed: Jun. 16, 2021

(65) Prior Publication Data

US 2021/0310230 A1 Oct. 7, 2021

Related U.S. Application Data

(63) Continuation of application No. 16/894,340, filed on Jun. 5, 2020, now Pat. No. 11,041,298, which is a continuation of application No. 15/832,486, filed on Dec. 5, 2017, now Pat. No. 10,711,446.

(51) Int. Cl.

| | |
|---|---|
| ***E02B 11/00*** | (2006.01) |
| ***E03F 3/06*** | (2006.01) |
| ***E21B 7/04*** | (2006.01) |
| ***E21B 7/20*** | (2006.01) |

(52) U.S. Cl.

CPC ..... *E03F 3/06* (2013.01); *E02B 11/00* (2013.01); *E21B 7/046* (2013.01); *E21B 7/20* (2013.01)

(58) Field of Classification Search

CPC ..... E02B 11/00; E02D 3/10
USPC ..... 405/36, 43, 45, 50, 51
See application file for complete search history.

(56) References Cited

U.S. PATENT DOCUMENTS

| | | | | |
|---|---|---|---|---|
| 4,820,080 A | | 4/1989 | Varkonyi et al. | |
| 4,892,440 A | | 1/1990 | Regan | |
| 5,271,693 A | * | 12/1993 | Johnson | E21B 43/38 405/128.4 |

(Continued)

FOREIGN PATENT DOCUMENTS

| | | |
|---|---|---|
| GB | 2208465 A | 4/1989 |
| WO | 2016163191 A1 | 10/2016 |

*Primary Examiner* — Sean D Andrish
(74) *Attorney, Agent, or Firm* — Goodhue, Coleman & Owens, P.C.

(57) ABSTRACT

A trenchless collector system is configured to intercept and direct surface and/or subsurface fluids to a designated reception location to control groundwater elevations. A target collection and drainage area is identified and a gravity drainage pipe is accessed or trenchlessly installed at the target collection and drainage area. The gravity drainage pipe can be accessed at one or more drawdown points. One end of a collection pipe can be connected to the gravity drainage pipe. Surface and subsurface water is hydrostatically drawn into the collection pipe from the target collection and drainage area through venting at the one end of the collection pipe connected to the gravity drainage pipe. The surface and subsurface water can be passively drained from the collection pipe into the gravity drainage pipe and onto the designated reception location.

17 Claims, 12 Drawing Sheets

(56) References Cited

U.S. PATENT DOCUMENTS

| | | | | |
|---|---|---|---|---|
| 6,273,512 | B1 | 8/2001 | Rajewski | |
| 6,705,801 | B1 | 3/2004 | Kiest | |
| 7,325,559 | B2 | 2/2008 | Darut et al. | |
| 7,473,373 | B1 * | 1/2009 | Danler | E03F 1/00 210/170.03 |
| 7,963,722 | B2 | 6/2011 | Kögler | |
| 7,980,273 | B2 | 7/2011 | Robinson | |
| 8,152,997 | B1 | 4/2012 | Olson et al. | |
| 8,529,159 | B2 | 9/2013 | Lemons | |
| 9,027,390 | B1 | 5/2015 | Rigby | |
| 9,061,333 | B2 | 6/2015 | Swearingen et al. | |
| 10,711,446 | B2 | 7/2020 | Jurgens et al. | |
| 2006/0088382 | A1 | 4/2006 | Nelson | |
| 2009/0194290 | A1 | 8/2009 | Parks et al. | |

* cited by examiner

TRENCHLESSLY INSTALLED SUBTERRANEAN COLLECTOR DRAIN FOR SURFACE AND SUBSURFACE WATER

CROSS-REFERENCE TO RELATED APPLICATIONS

This is a Continuation of U.S. application Ser. No. 16/894,340 filed on Jun. 5, 2020, which is a Continuation of U.S. application Ser. No. 15/832,486 filed on Dec. 5, 2017, which are hereby incorporated by reference in their entirety.

BACKGROUND

I. Field of the Disclosure

Storm sewers are installed for the purpose of collecting and transporting surface water. Storm sewer pipes can be installed through conventional excavation as well as trenchless methods such as directional drilling, augering, boring or similar methods. Storm sewers include inlets such as catch basins and manhole structures attached to a piping system for the purpose of collecting surface water.

The present disclosure relates to a subterranean collector piping system. More specifically, but not exclusively, the present disclosure relates to a trenchlessly installed subsurface collector, method and system for capturing and transporting subsurface and/or surface fluid from a designated area. The present invention provides a method for extracting groundwater and other liquids using natural means to lower a localized groundwater table without the need for mechanical equipment, or the consumption of energy. The present invention also provides for extracting groundwater and other liquids using mechanical equipment, or the consumption of energy means to lower a localized groundwater table.

II. Description of the Art

Dealing with subsurface localized water tables (fluctuating water table, movement of contaminates) has become increasingly problematic over time and is projected to be an even greater future concern as sanitary sewers are being trenchlessly rehabilitated and sealed. Both public and private organizations as they conform to current and emerging federal and state requirements to seal their sewer collection systems now find themselves dealing with the consequences of increased localized water tables. The subsurface water may be contaminated with chemicals, oil, or other contaminates. Billions of dollars are spent each year in the United States to tighten up old leaking sewers systems utilizing trenchless processes such as cured-in-place pipe (CIPP) and expanding gaskets in an effort to eliminate inflow and infiltration (I&I) flows from reaching sewer treatment plants or causing wastewater back-ups into businesses or homes or causing a sanitary sewer overflow (SSO) or combined sewer overflow (CSO). These old leaking sewers have unintentionally performed for many years as french-drains, unnaturally controlling the localized water table. Today, the EPA (Environmental Protection Agency) has mandated utility owners to remove extraneous flows by rehabilitating the collection system. Wastewater collection systems managers, having efficiently dealt with I & I, are now dealing with unexpected nuisance water situations and homeowner complaints such as: sump pumps never shutting off, increased electric costs, replacing worn out sump pumps, heaving of basements floors, bowing of foundation walls, all due to the increased hydrostatic pressure caused from the rise in localized water tables. In some areas, the sealing of sewer collection systems has caused soil saturation to increase turning homeowner yards into marshland. A classic example of fixing one problem and causing a new problem.

Therefore, it is an object, feature, or advantage of the present disclosure to provide a subterranean collector system that can drawdown subsurface and/or surface water to control localized water tables.

Therefore, it is an object, feature, or advantage of the present disclosure to utilize trenchless (no trenching or minimally invasive) methods for installing a subterranean collector pipe and forming subsurface and/or surface drawdown points at designated locations along the length of the drain pipe, allowing groundwater to gravity flow and discharge into a designed location where the elevation is suitable for the purpose of discharging captured water from a target area and lowering the localized water table in the target area.

Therefore, it is an object, feature, or advantage of the present disclosure to utilize trenchless (no trenching or minimally invasive) methods for installing a subterranean drain pipe and forming subsurface and/or surface drawdown points at designated locations along the length of the drain pipe, pumping of groundwater and discharging to a designed location for the purpose of discharging captured water from a target area and lowering the localized water table in the target area.

As sewer collection system are rehabilitated and sealed, hydrostatic pressures increase causing structural damage and flooding to homes, buildings, and other subterranean structures. The result is soil saturation to a point where percolation is no longer possible.

Pollutants may be suspended in the subsurface water and can migrate causing contamination to spread to other areas impacting the environmental and human health. Groundwater pollution can originate from many sources, and occurs when harmful substances mix with ground water. Harmful substances may include fertilizers, pesticides, herbicides, as well as chemicals that can leach into surrounding soils from leaking underground storage tanks, potentially contaminating aquifers which serve as a source for drinking water.

Therefore, another object, feature, or advantage of the present disclosure is to provide a subterranean collector piping system configured to direct subsurface and/or surface water from a target collection area to a designated reception location to obviate one or more of the above-identified issues.

Therefore, another object, feature, or advantage of the present invention is to filter the water entering a subterranean drain pipe.

Therefore, another object, feature, or advantage of the present invention is to provide methods for internally perforating a subterranean drain pipe and remotely inserting and positioning an internal filter apparatus Therefore, another object, feature, or advantage of the present invention is to provide methods for providing surface access at each of the subterranean drain pipe for efficient maintenance of the pipe, internal filters, and insertion of robotic equipment used to create perforations in the drain pipe.

A still further object, feature, or advantage of the present disclosure is to provide a trenchlessly installed collector piping system including subsurface and/or surface drawdown points configured to capture subsurface water from saturated soils and relocating the water to a designated reception area controlling seasonal subsurface hydrostatic fluctuation zones.

One or more of these and/or other objects, features or advantages of the present disclosure will become apparent from the specification and claims that follow.

SUMMARY OF THE DISCLOSURE

The present disclosure provides a trenchlessly installed drain piping system having subsurface and/or surface drawdown points consisting of perforations in the drain pipe, and/or a perforated branch pipe extending in a vertical direction from the drain pipe, method, and/or system for directing subsurface water from a targeted collection area to a designated reception location.

One exemplary embodiment provides a drain pipe configured to collect subsurface and/or surface water through drawdown points along the length of the drain pipe and transport the ground water to a designated reception location. In one aspect, a target area or zone is identified and a drain pipe is trenchlessly installed. The drain pipe can be accessed at one or more collection (drawdown) points using minimally invasive methods. In one embodiment, a branch pipe is connected to the collection pipe. By extending the drawdown branch pipe to or near the surface, future access can be obtained for maintenance of the piping system. The subsurface and/or surface water can be passively drained into the drain pipe through at least one opening in the drain pipe, or from a branch pipe extending from the drain pipe having at least one opening. It is preferred the branch pipe is perforated and the branch pipe includes an external filter sock or an internal filter preventing granular soil from entering the piping system.

Another exemplary embodiment provides a drawdown apparatus consisting of a branch pipe extending from the drain pipe for collecting subsurface and/or surface water from a target area and transporting to a designated reception location. The apparatus includes a pipe with first and second terminal ends spaced apart by an outer cylindrical wall. One or more subsurface and/or surface drawdown points can be configured in the outer cylindrical wall at a level for passively drawing subsurface and/or surface water at a desired elevation.

Yet another exemplary embodiment provides a subterranean collector piping system installed from a target collection area extending to a designated reception location. In one aspect, a small diameter vertical borehole is formed by use of a vacuum to remove soil and expose the horizontal drain pipe. One or more drawdown points can be configured generally vertically from ground surface to the drain pipe. A drawdown branch pipe is inserted into the vertical borehole and attached to the drain pipe forming a drawdown point for collecting subsurface and/or surface waters into the collection pipe. One end of the drawdown branch pipe included a saddle for attaching the branch pipe to the drain pipe.

Still another exemplary embodiment provides a method for retrofitting an existing gravity drain pipe for passively draining subsurface and/or surface water from a collection area. Vertical branch pipes are provided at designated locations along the length of the existing gravity drain pipe forming drawdown points for collecting subsurface and/or surface water and transporting to a designated receiving location. The buried gravity drainage pipe is accessed, preferably using vacuum excavation to form a small diameter bore hole for the purpose of inserting a vertical perforated branch pipe attached to the existing gravity drain pipe.

BRIEF DESCRIPTION OF THE DRAWINGS

Illustrated embodiments of the present disclosure are described in detail below with reference to the attached drawing figures, which are incorporated by reference herein, and where:

FIGS. 11A-111B are pictorial representations of an adjustable mechanism for a collector system in accordance with an illustrative embodiment.

DETAILED DESCRIPTION OF THE DISCLOSURE

The present disclosure relates to a subterranean collector of waters. More specifically, but not exclusively, the present disclosure relates to a trenchlessly installed collector system, method and system for capturing and draining off subsurface and/or surface water from targeted area(s).

It is known that handling and dealing with subsurface flow of fluids (fluctuating water table, movement of contaminates) is an ever-increasing problem and is projected to be an even greater future concern. Another problem is surface waters resulting from intense storm events.

As both public and private organizations, conform to current and emerging federal and state requirements find themselves dealing with nuisance water issues. Billions of dollars are spent each year in the United States to tighten up existing gravity pipe systems, typically utilizing cured-inpipe (CIPP) with expanding gaskets in an effort to eliminate inflow and infiltration (I&I) flows from reaching sewer treatment plants or causing wastewater back-ups into businesses, or homes or causing a sanitary sewer Overflow (SSO), or combined sewer overflow (CSO). Wastewater collection systems managers, having efficiently dealt with I & I are now dealing with new nuisance water situations.

It is also known that surface runoff occurs once the ground has been saturated to a point where it cannot hold any more water. In some cases, runoff flows enters structures, into homes or onto land, where it can cause damage and can lead to law suits. Runoff can also pass into small ditches or channels that run through or adjacent to property, and if not maintained these can become blocked causing extensive damage to property. Chemicals or pollutants present on the land can be transported by the moving water. Runoff can carry pollutants to locations that impact both environmental and human health. Pollution is a major concern when it comes to issues affecting groundwater. Groundwater pollution can originate from many sources, and occurs when harmful substances (contaminates) percolate the soil. Fertilizers, pesticides, and herbicides can be carried by runoff or thru percolate soils. Chemicals, when not properly disposed can leach into groundwater as well as unintended sources such as underground storage tanks allowing for exfiltration or leakage from industrial storage tanks and gas stations are a few examples of other sources. In any event, these issues existing in the art are evidenced, for example, in patents such as U.S. Pat. No. 9,027,390 to Rigbly that discloses a SYSTEM AND METHOD OF DETERMINING SOURCES OF WATER INFILTRATION/INFLOW INTO A SEWER.

What follows are exemplary aspects and descriptions for one or more of the apparatuses, systems, methods of the present disclosure addressing deficiencies and inadequacies of the current state of the art.

Figure 1:
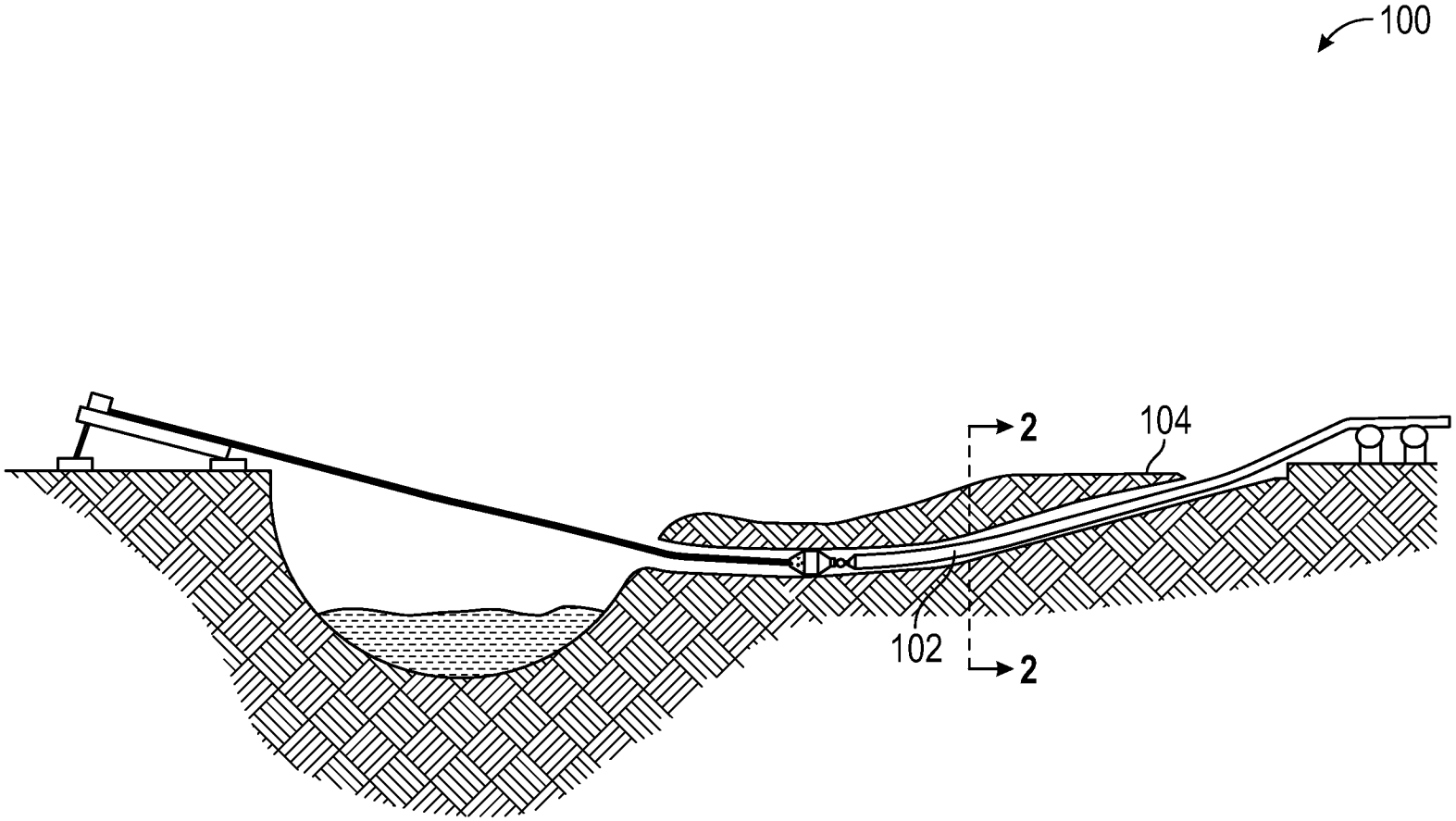
FIG. 1 is a pictorial representation of a trenchless installation of a drain pipe in accordance with an illustrative embodiment.
Figure 2:
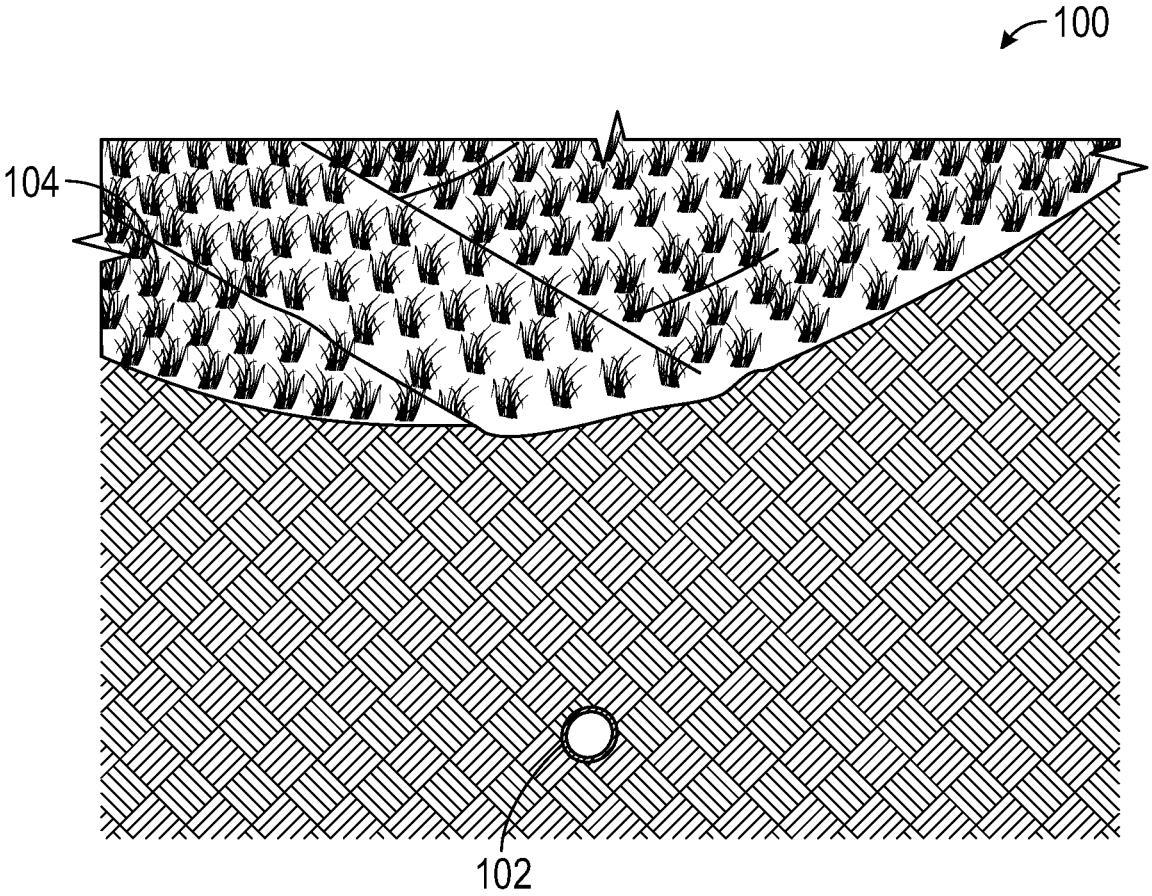
FIG. 2 is a pictorial representation of a cross section view for the installed drain pipe shown in FIG. 1 in accordance with an illustrative embodiment.

It is known excavation for remediating nuisance subsurface water and/or surface water is expensive, highly disruptive, takes an excessive amount of time, inconvenient and can be dangerous for workers, potential collateral damage to surrounding utilities, and are often disruptive for surrounding businesses and landowners. Notwithstanding these known concerns and issues, excavation has been the only known viable option for remediating many of the water nuisance issues identified herein. Presently, there is not a minimally invasive technique adequately addressing extraneous, nuisance and/or uncontrolled surface and subsurface fluid flows. Common construction standards regulated by City, State and Federal policy require excavation spoils (soil removed from a trench) to be deposed offsite from the construction site and fresh fill material delivered to the jobsite for compaction around the newly installed pipe and compacted in lifts filling the trench to the surface grade in an effort to eliminate or reduce settling of the trench. These excavation practices used to install gravity pipes is not only a costly endeavor, it is also disruptive to citizens and commerce as the process requires a large construction foot print and necessitates many days of construction activity. Trenchless processes such as drilling, auguring, boring allow for hundreds of feet of conduit to be installed in one day and provides an alternative to excavation for installing new pipes. As shown pictorially in FIG. 1, installation of a drainage pipe 102 by a horizontal directional drilling system 100 such as provided in U.S. Pat. No. 7,963,722 to Kogler, incorporated herein by reference, which discloses a METHOD FOR THE TRENCHLESS LAYING OF PIPES, is a viable alternative for constructing new pipelines without the consequences resulting from excavation. A horizontal directional drilling system 100, such as the one pictorially represented in FIG. 1, can be installed at a target collection and drainage area 104 by the aforementioned trenchless operation in Kogler. Thus, having identified a target collection and drainage area 104 with any one of the aforementioned issues resulting from extraneous, nuisance and/or uncontrolled surface and/or subsurface fluid flows, the trenchless operation in Kogler can be used to install a drainage pipe 102 by the horizontal directional drilling system 100. The drainage pipe 102 can be an entirely new drainage pipe or a replacement for an existing inoperable, inadequate or failing drainage pipe or system. FIG. 2 is a pictorial representation of a cross section view for the drainage pipe 102 shown in FIG. 1 installed at the target collection and drainage area 104 by the horizontal directional drilling system 100. As shown, the surface of the target collection and drainage area 104 is virtually uninterrupted by the horizontal directional drilling system 100. In this manner, the drainage pipe 102 is introduced at the subterranean target collection and drainage area 104.

Figure 3:
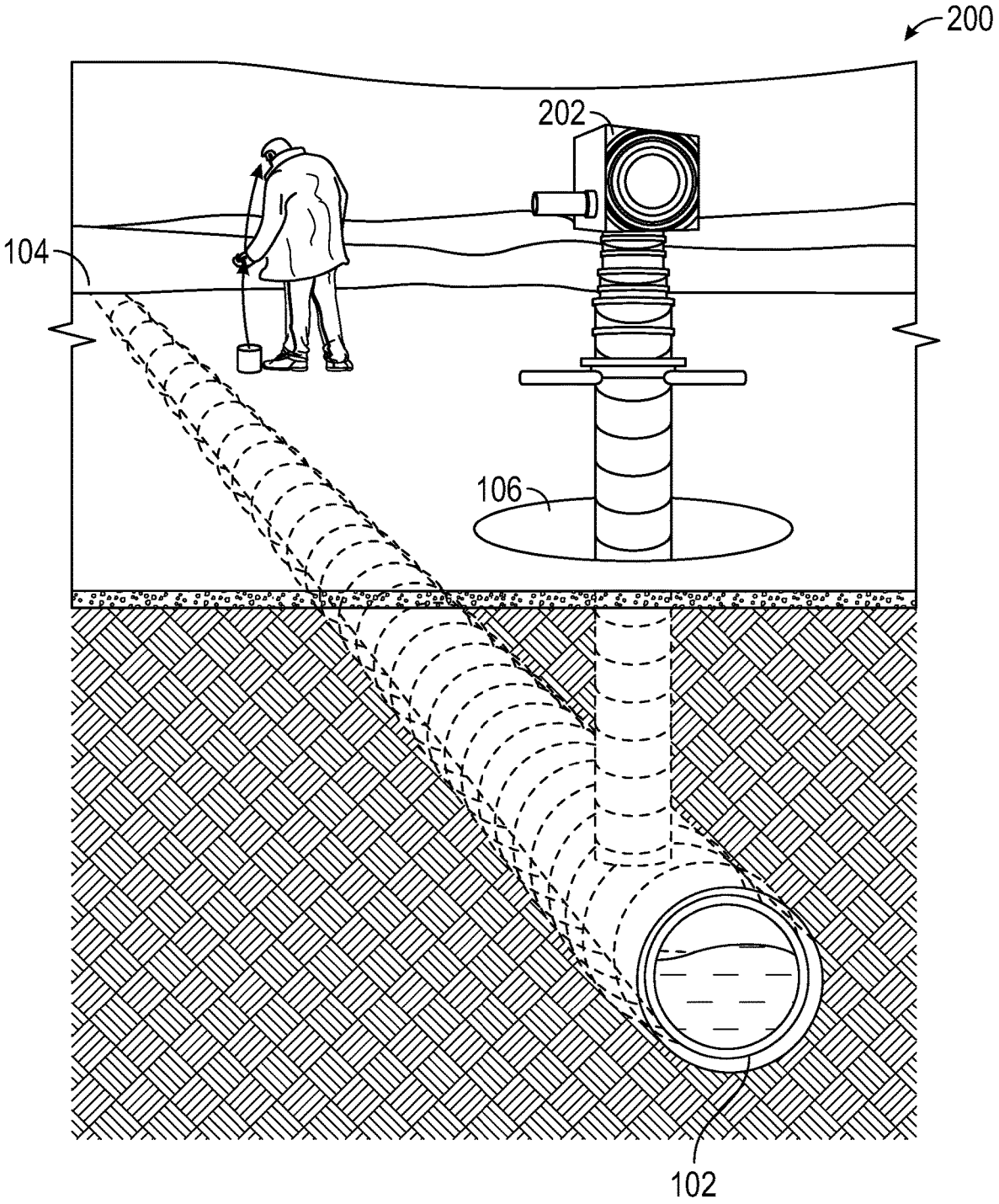
FIG. 3 is a pictorial representation of a drain pipe being located that includes a detectable location wire or similar devices. The purpose of locating the drain pipe is to determine the exact location for creating a drawdown hole identified in accordance with an illustrative embodiment.

FIG. 3 provides a pictorial representation of a drawdown point detection system 200 in accordance with an aspect of the present disclosure. Once the drainage pipe 102 is installed at the target collection and drainage area 104 by the horizontal directional drilling system 100 disclosed pictorially in FIG. 1, detection of the installed subterranean drainage pipe 102 can be achieved as pictorially represented in FIG. 2 and further described, by way of example, in U.S. Pat. No. 6,750,401 to Vokey setting forth at least one known method, incorporated herein by reference, for using trace wire for transmission of a tone for locating underground utilities and cables, or in the instant case, a drainage pipe 102. A detector 202 can be used at the target collection and drainage area 104 to detect the location of the installed subterranean drainage pipe 102 and to determine specifically where to create one or more drawdown holes 106 using minimally invasive methods as described in ASTM 3097-15, Standard Practice for Installation of an Outside Sewer Service Cleanout through a Minimally Invasive Small Bore Vacuum Excavation, for accessing the drainage pipe 102. The one or more drawdown holes 106 can be located at any point along the installed drainage pipe 102. Determination of the location of the one or more drawdown holes 106 is further described as shown in the preceding figures and description.

Figure 4:
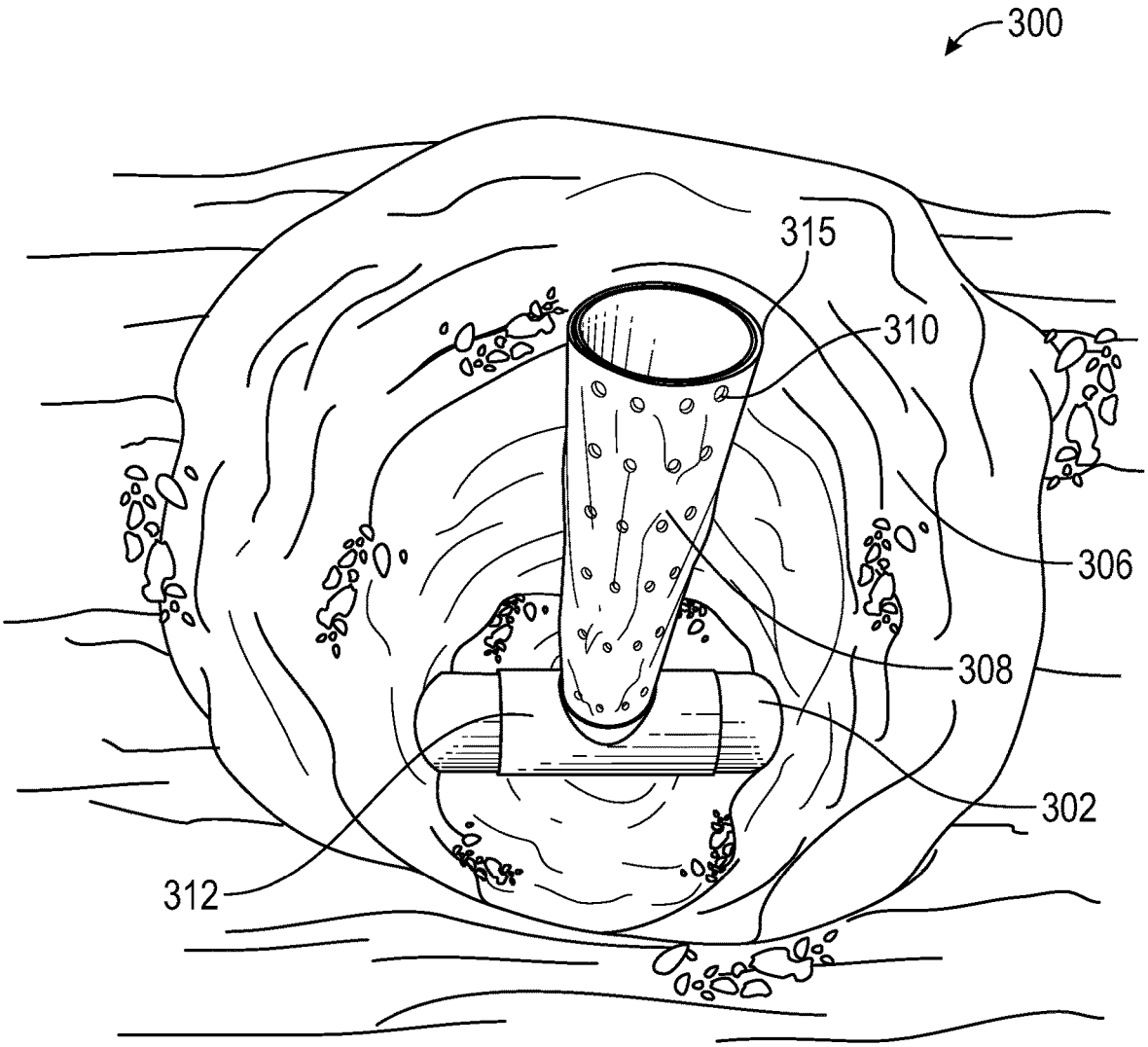
FIG. 4 is a pictorial representation of a collection pipe and a vertical perforated drawdown branch pipe at a drawdown point in accordance with an illustrative embodiment.
Figure 11A:
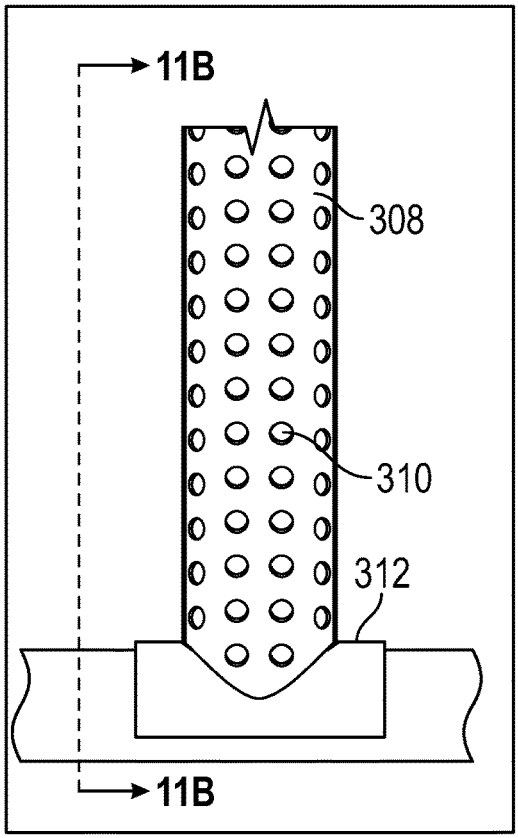
Figure 11B:
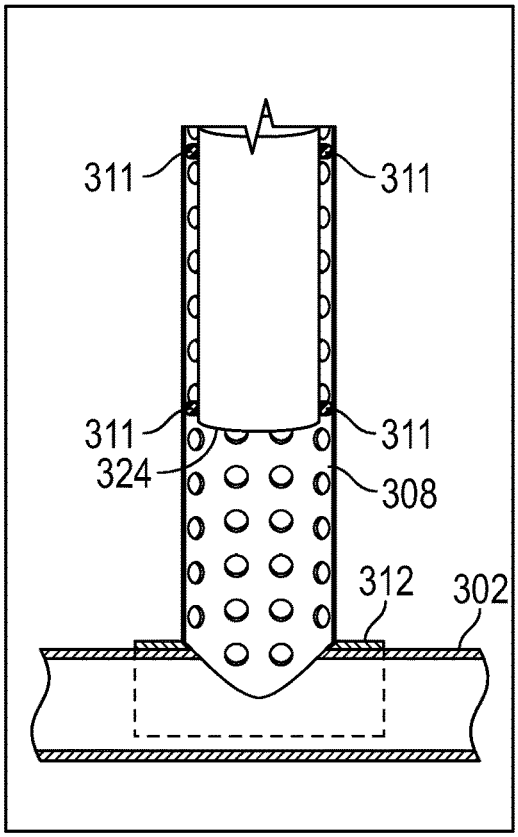

FIG. 4 provides a pictorial representation of a trenchlessly installed collection and drainage pipe system 300 of the present disclosure installed at a drawdown point 306 within a drawdown hole, such as the drawdown hole 106 pictorially represented in FIG. 3. The collection and drainage pipe system 300 includes, has pictorially shown, in at least one aspect of the present disclosure, a drainage pipe 302 to which a collection pipe 308 is coupled by means of a pipe attachment 312. The collection pipe 308 can include a fabric wrap cloth 315 protecting the perforations 310. The wrap cloth is used to minimize/eliminate soil migration. The pipe attachment 312 can be a pipe saddle fitting, such as those customarily known in the art. At least one method for trenchlessly forming a drawdown hole at a drawdown point 306 for connecting an upstanding access pipe to a buried pipe, and subsequently cutting a hole in the buried pipe to provide communication from the upstanding access pipe into the buried pipe is shown in described in U.S. Pat. No. 6,705,801 to Kiest, which is incorporated herein by reference and discloses an APPARATUS AND METHOD FOR PROVIDING ACCESS TO BURIED PIPE. Similarly, in a manner akin to the method shown in the Kiest patent, a drawdown access hole can be vacuum excavated (or other) at a drawdown point 306 to install a collection pipe(s) 308 to the drainage pipe 302 and create an opening in the drainage pipe 302 for connecting the collection pipe 308 to drainage pipe 302 for providing fluid communication between the two pipes. A pipe attachment 312 such as a pipe saddle fitting can attach the collection pipe 308 to the drainage pipe 302 akin to the method pictorially represented and described in U.S. Pat. No. 6,705,801 to Kiest. The collection pipe 308 can include, at the time of installation, a plurality of perforations when attached to 312 as pictorially represented in FIG. 4. It should be understood that the groundwater levels can be controlled by the depth of the perforations in the collection pipe. In one embodiment, the collection pipe includes perforations over its entire length (FIG. 11A) and an internal adjustable mechanism 324 for isolating perforations at varying depths (FIG. 11B). This mechanism closes or opens the perforations and depth controlling the elevation of the localized or seasonal water table, similar to a dam. For example: If the drain pipe is ten (10) feet in depth and the collection pipe includes perforations over its entire length, the collection pipe would be capable of lowering the ground water table to a depth of 10 feet below surface. However, if the local governing agency desired to raise the water table to a depth of 5-feet below surface, the internal mechanism would be adjusted to isolate and close off lower perforations. Such a mechanism may be comprised of an internal sleeve 324 including a gasket so as to form a watertight seal at its lower end.

When installing pre perforated collection (PPP), a fabric filter wrap (FFW) 315 can encompass areas of PPP where perforations are located. The FFW will reduce or eliminate migration of soil fines depending upon soil conditions. Over time the FFW can become inefficient due to compacted soil particles and cleaning or replacing the filter may be necessary to obtain efficient operation. In the case of an external filter wrapping around the exterior surface of the perforated collection pipe, cleaning can be achieved by inserting a plug, either pneumatic or mechanical at a position below the perforations, followed by pressuring the collection pipe with a fluid causing exfiltration of fines, thus dislodging fines which may be trapped in the FFW, and improving efficiency. An internal filter media may alternately be used which allows for simple maintenance operation whereby the filter can be removed to clean or replace the filter media. As an example, an internal filter media is positioned on the interior surface of the perforated collection pipe and can be of a semi-rigid construction so as to be self-supporting and not collapse under a hydraulic load. The filter can also be supported by a rigid or semi-rigid body positioned on the interior surface of the filter media. In an effort to minimize soil particles from entering the collector pipe at the bottom of the internal filter, the filter may be outfitted with a gasket such as an O-ring located at the bottom of the filter media so as to form a watertight seal.

Figure 5:
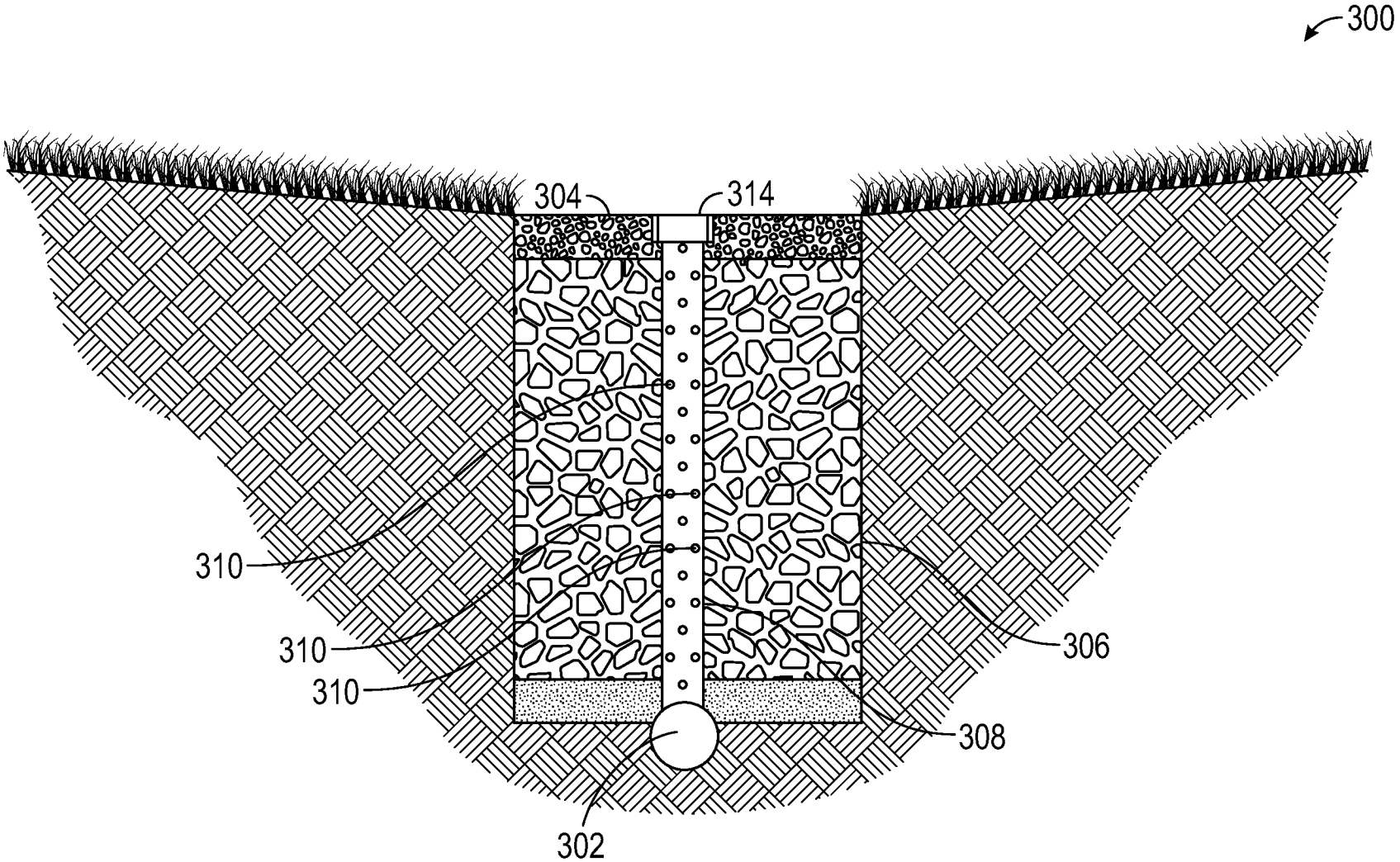
FIG. 5 is a pictorial representation of a cross sectional view of the collection and drainage pipe at the drawdown point shown in FIG. 4 in accordance with an illustrative embodiment.

Alternatively, a plurality of perforations in the collection pipe 308 and to the drain pipe 302 can be created after the pipe has been installed using robotic methods known in the art for in-situ creation of perforations in the wall of an installed, solid-walled pipe, such as collection pipe 308 and drain pipe 302 having non-perforated sidewalls or solid sidewalls at the time of installation. The purpose of the plurality of perforations 310, whether created before or after installation, provide passage of external fluid into the drainage pipe system 300. The collection pipe 308 has two open ends, a lower end installed in fluid and open communication with the drainage pipe 302 and an opposite upper end, either buried and capped by way of a removable cap at a predetermined depth or open to and in communication with the atmosphere as is pictorially represented in FIG. 5. In this manner, the collection and drainage pipe system 300 functions as a gravity drainage system by permitting any fluid at the target collection and drainage area 304 to migrate under gravity into the collection pipe 308 by passing through the plurality perforations 310, through the collection pipe 308 into the drainage pipe 302. Fluid at the drawdown point 306 is collected within the collection pipe 308 as gravity moves fluid into the collection and drainage pipe system 300 which may be buried below or brought to surface 320, for example, through a catch basin thereby allowing fluid collected at the drawdown point 306 to migrate under gravity into the drainage pipe 302. Any number of collection pipes 308 can be installed along the length of a drainage pipe 302. Collection pipes 308 can be installed along the length of the drainage pipe 302 at any calculated interval. For example, collection pipes 308 can be spaced apart 5-10 feet or any other desired distance whether greater are smaller, which may be optimally spaced based on the sphere of influence, drawdown space or cone of depression around each one of the collection pipes 308 as pictorially represented in FIGS. 6A-6B. Thus, the separation distance between each collection pipe 308 can be controlled so that the sphere of influence of each pipe overlaps or is in close proximity with an adjacent pipe thereby creating a drainage fence or wall along the length of the drainage pipe 302. For purposes of example only, a pair of collection pipe 308 can be spaced 10 feet apart if it's determined were approximated that each collection pipe 308 as the sphere of influence of roughly 5 feet. Placement of a plurality of collection pipes 308 along the length of the drainage pipe 302 can provide intermittently spaced drainage points and/or a drainage fence, as it were, collecting fluid migrating toward the collection and drainage pipe system.

Figure 6A:
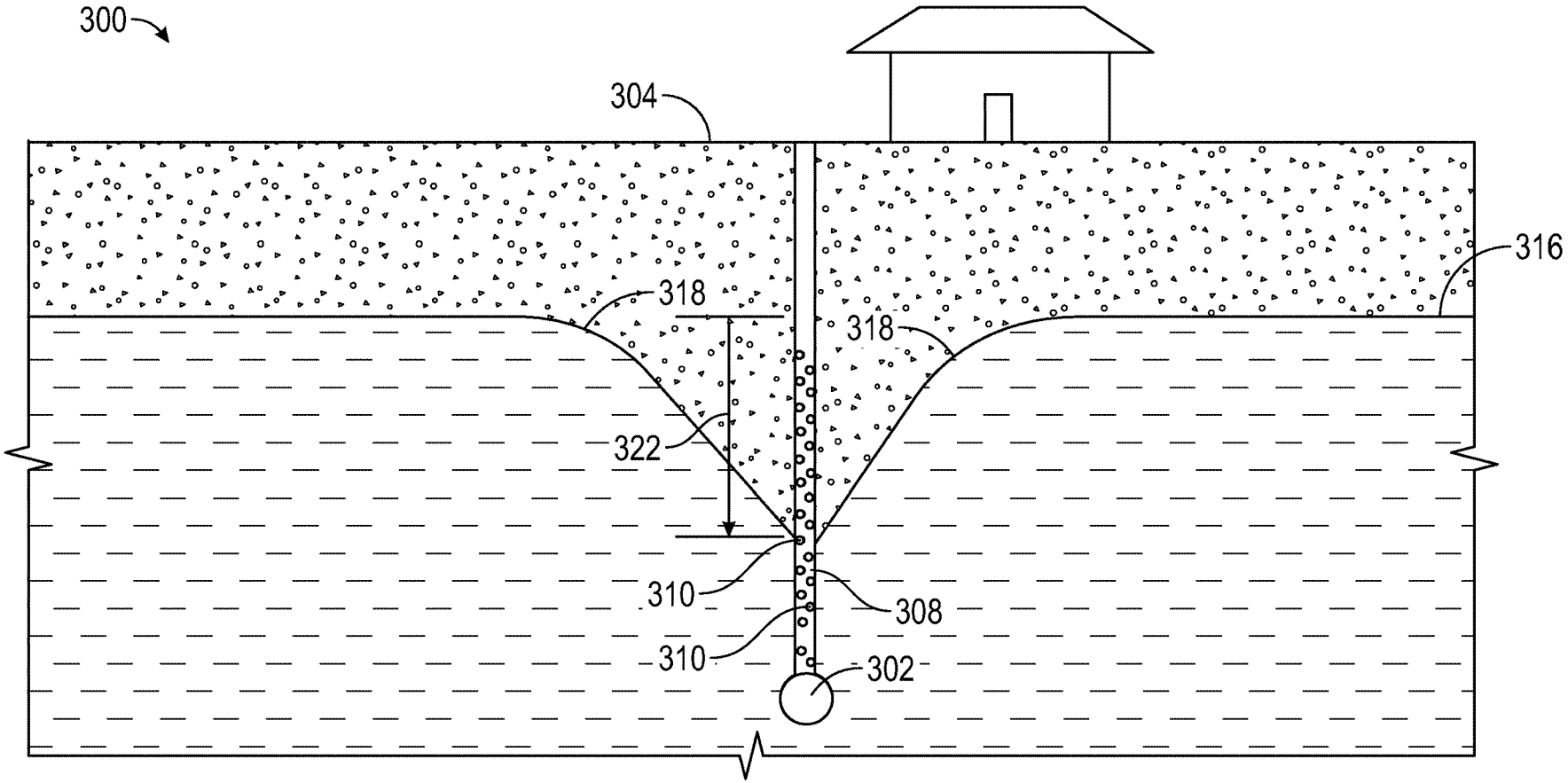
FIG. 6A is a pictorial representation of an operational view of a subterranean collector system in accordance with an illustrative embodiment.
Figure 6B:
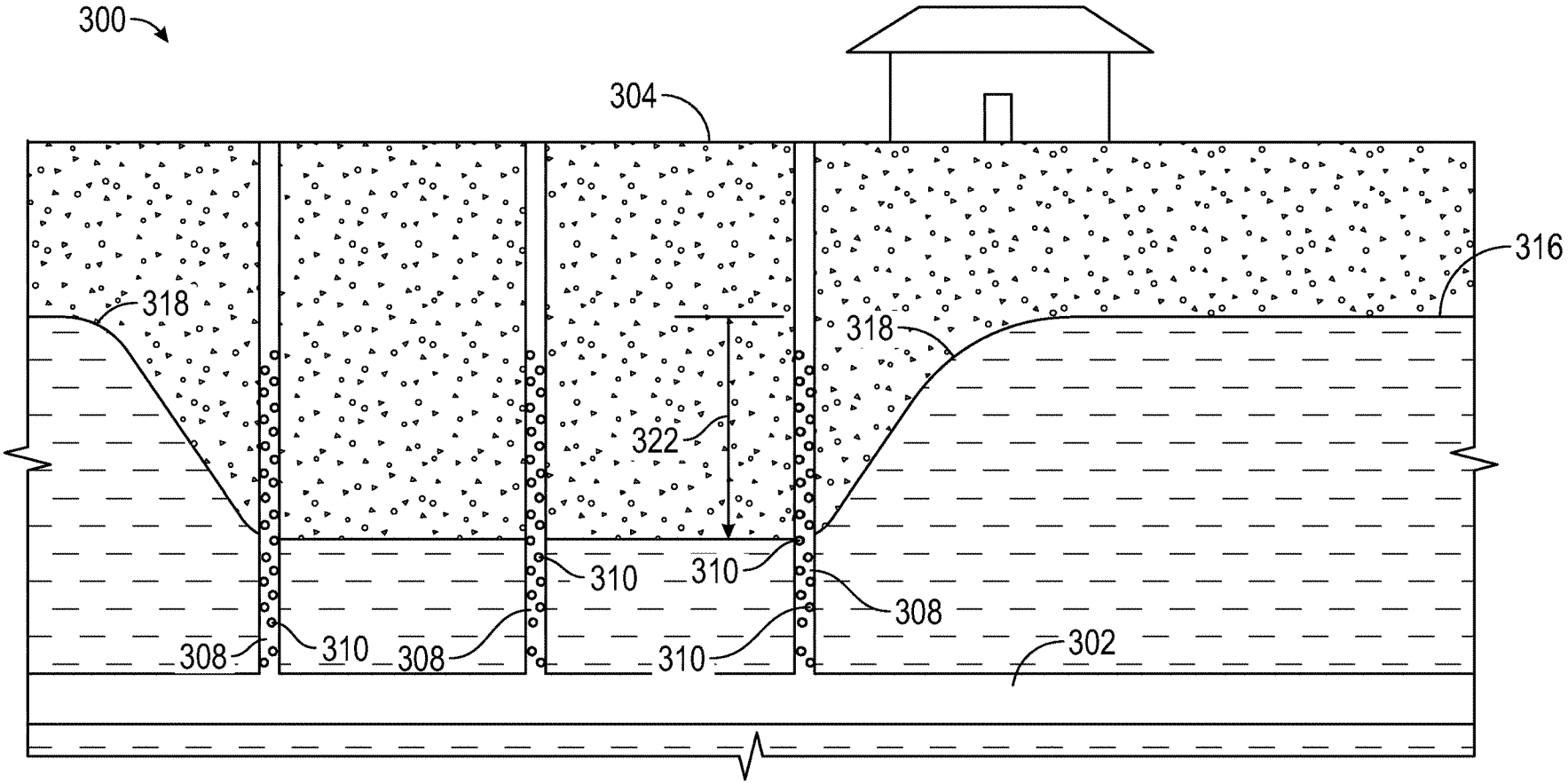
FIG. 6B is a pictorial representation of an operational view of a subterranean collector system in accordance with another illustrative embodiment.

FIGS. 6A-6B provide a pictorial representation of a collection and drainage pipe system 300 installed by a trenchless operation at a target collection and drainage area 304 as previously set forth herein. One or more collection pipes 308 are operably attached, as previously set forth herein, to a drainage pipe 302. The collection pipe 308 includes a plurality of perforations 310, created prior to or after installation of the collection pipe 308 to the drainage pipe 302. As previously described, each one of the collection pipes 308 has a sphere of influence on the surrounding fluid (e.g., a water table 316 for purposes of illustration in FIGS. 6A-6B) represented by a cone of depression 318 or the amount of drawdown 322. The amount of drawdown 318 shows pictorially the effect of a collection pipe 308 on the surrounding fluid. A cone of depression 318 runs along the length of a drainage pipe 302 as a result of the collection pipes 308 being intermittently spaced along the length of the drainage pipe 302. The drawdown 318 affect is achieved passively as fluid migrates by force of gravity into each collection pipe 308. The fluid collected in each collection pipe 308 is drained off and away from the target collection and drainage area 304 by means of the drainage pipe 302. Thus, the collection and drainage pipe system 300 can be installed by the trenchless operation described herein at a target collection and drainage area 304 to remediate extraneous, nuisance and/or uncontrolled surface and subsurface fluid flows. Although it is known surface fluid will eventually migrate underground, the collection and drainage pipe system 300 can also be configured to collect surface fluid in its immediacy upon development through a vent 314, operating also as a surface drain, as pictorially represented in FIG. 5.

Figure 7A:
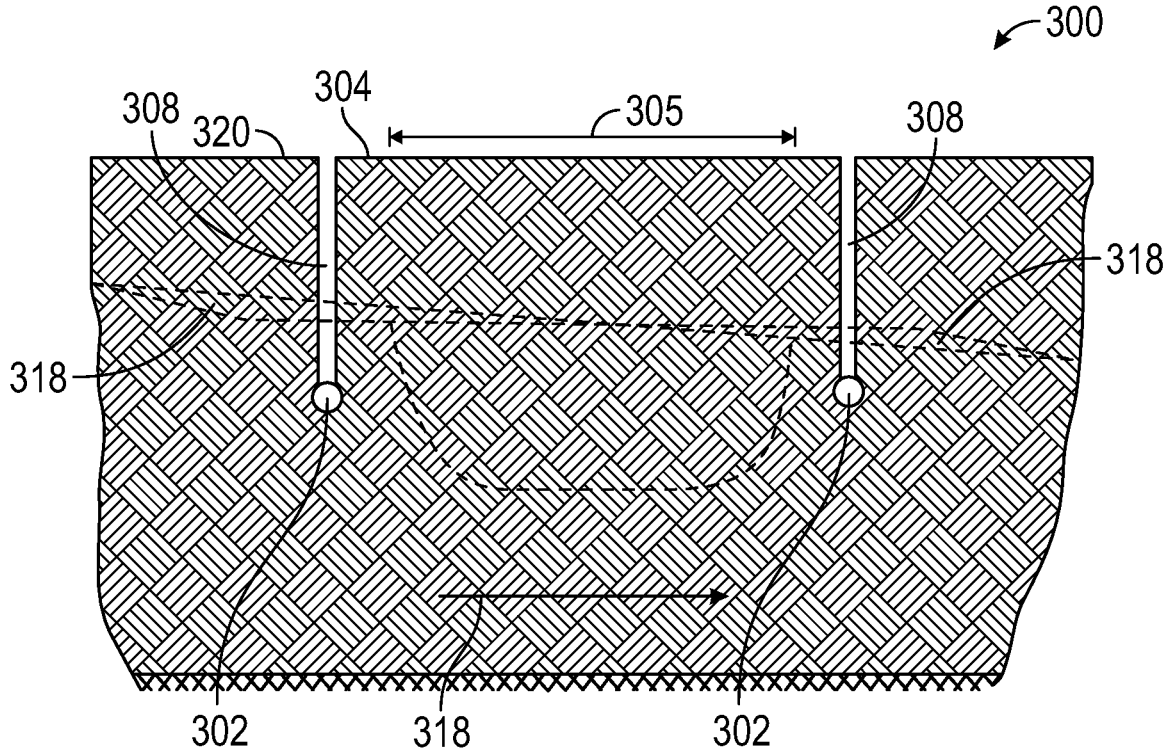
FIGS. 7A-7B are pictorial representations of an operational view of a trenchless collector system for collecting from a contaminated area in accordance with an illustrative embodiment.
Figure 7B:
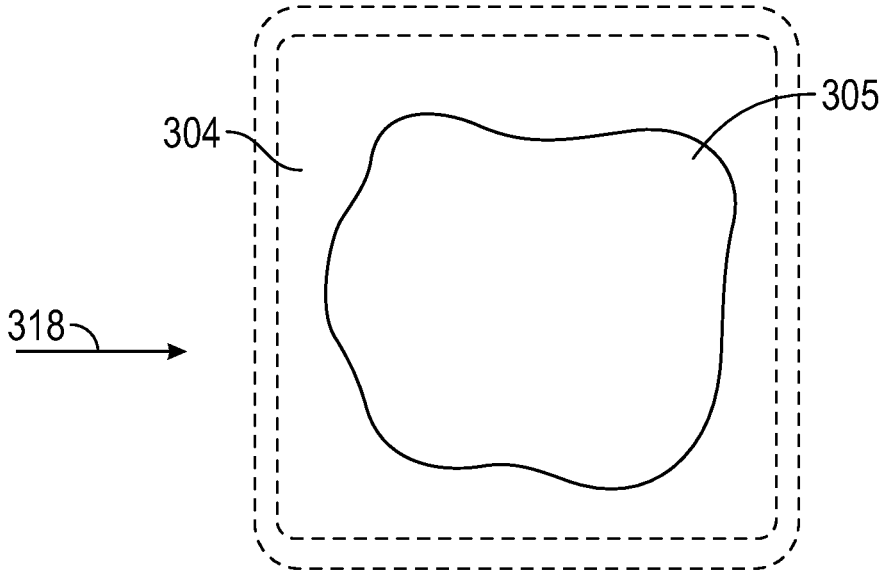

FIGS. 7A & 7B provide another example of a collection and drainage pipe system 300 in accordance with contemplated aspects of the present disclosure. By way of example, the target collection and drainage area 304 is shown as a contaminated area 305 which groundwater fluid flows 318 can pass through thereby presenting a cause for concern. One or more collection and drainage pipe systems 300 can be installed at the target collection and drainage area 304 to remediate unwanted migration of the contaminates. As represented pictorially, a target collection and drainage area 304 comprising the contaminated area is bordered, for example, by a pair of collection and drainage pipe systems 300. The system includes a collection pipe 308 connected to a drainage pipe 302 and a plurality of perforations in the collection pipe 308 for permitting fluid migration into each collection and drainage pipe system 300, as previously set forth herein. A plurality of collection pipes 308 can be intermittently spaced, at calculated intervals, along the length of each drainage pipe 302 thereby creating, as it were, a fluid drainage fence for bordering and passively intercepting contaminant flow from the target collection and drainage area 304 and redirecting it to a designated reception area in fluid communication with one or more of the drainage pipes 302. Although a pair of collection and drainage pipe systems 300 are shown pictorially in FIGS. 7A-7B, the present disclosure contemplates any number of collection and drainage pipe systems 300 installed to adequately remediate extraneous, nuisance and/or uncontrolled surface and subsurface fluid flows at a target collection and drainage area 304. The collection and drainage pipe systems 300 can be installed in series, in parallel, and with redundancy as needed to adequately address and/or remediate extraneous fluid flow, contaminated fluid flow, or any of the like, whether surface or subsurface fluid, protecting receiving waters. In addition to addressing contaminated fluid flow, the collection and drainage pipe system 300 of the present disclosure can be configured as a collector storm line, foundation drain, roof drain, catch basin, storm water pit, or any of the like to address, remediate and redirect unwanted, extraneous fluid flow away from an existing, and possibly overwhelmed, sewer system and/or storm drain system. A collection and drainage pipe system 300 of the present disclosure can also be configured by trenchless operation as an underdrainage pipe to prevent extraneous groundwater from infiltrating into decrepit or overwhelmed sewage drainage systems. By way of example: a sanitary sewer pipe is located at a depth of 10-feet, and a trenchlessly drain pipe is located below or adjacent the sanitary pipe at a depth of 12-feet including a series of collection pipes with corresponding perforations to a depth of 12-feet. The drainage pipe system 300 would act as an underdrainage pipe lowering the ground water to an elevation below the sanitary sewer significantly reducing the ground water from infiltrating into the sanitary sewer.

Figure 8:
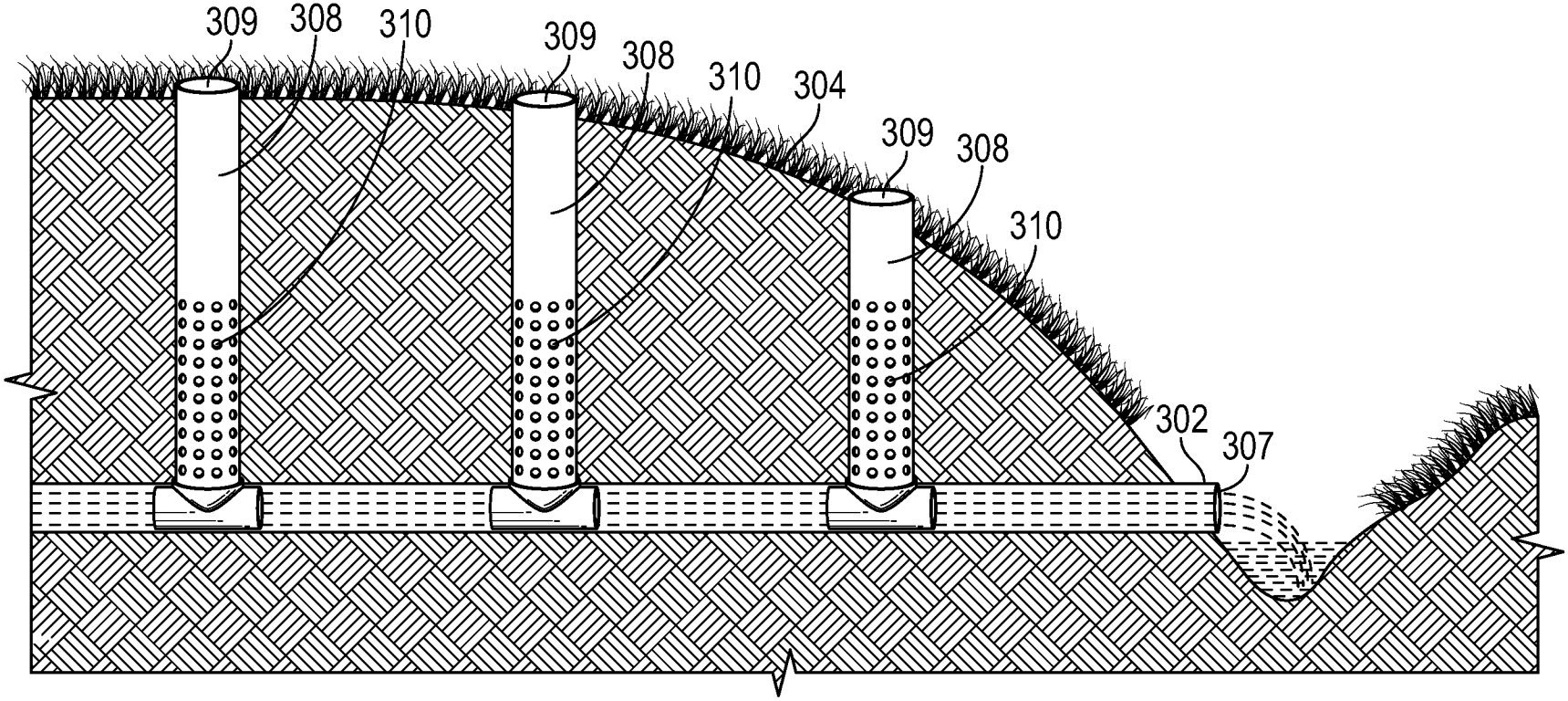
FIG. 8 is a pictorial representation of an operational view of a trenchless collector system in accordance with another illustrative embodiment.

FIG. 8 is a pictorial representation of another collection and drainage pipe system 300. The collection and drainage pipe system 300 includes one or more collections pipes 308 operably attached to as previously set forth herein, to a drainage pipe 302 that has a discharge point 307, for example, into a ravine or waterway. The collection pipe 308 includes a plurality of perforations 310, that can be created prior to or after installation of the collection pipe 308 to the drainage pipe 302. An access point, at or near ground, is provided at the vertical most end of each collection pipe 308. As previously described, each one of the collection pipes 308 has a sphere of influence on the surrounding fluid (e.g., a water table 316 for purposes of illustration in FIG. 6) represented by a cone of depression or the amount of drawdown 318. The amount of drawdown 318 shows pictorially the effect of a collection pipe 308 on the surrounding fluid. A cone of depression 318 runs along the length of a drainage pipe 302 as a result of the collection pipes 308 being intermittently spaced along the length of the drainage pipe 302. The drawdown 318 affect is achieved passively as fluid migrates by force of gravity into each collection pipe 308. The fluid collected in each collection pipe 308 is drained off and away from the target collection and drainage area 304 by means of the drainage pipe 302. Thus, the collection and drainage pipe system 300 can be installed by the trenchless operation described herein at a target collection and drainage area 304 to remediate extraneous, nuisance and/or uncontrolled surface and subsurface fluid flows. The placement of the perforations 310 along the length of the collection pipe 308 can be used to control the water table level of the surrounding fluid and the resulting sphere of influence. This can be achieved with one or more collections pipes as shown in FIG. 8.

Figure 9A:
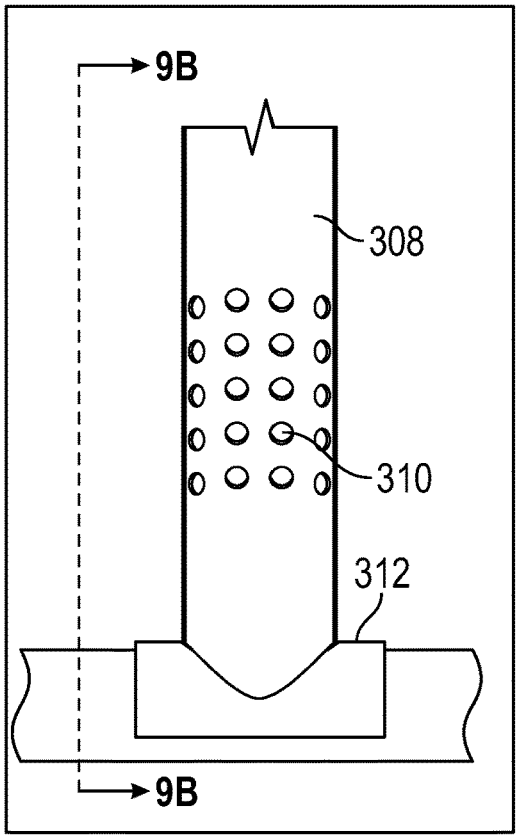
FIG. 9A is a pictorial representation of a filtering assembly for a collector system in accordance with an illustrative embodiment.
Figure 9B:
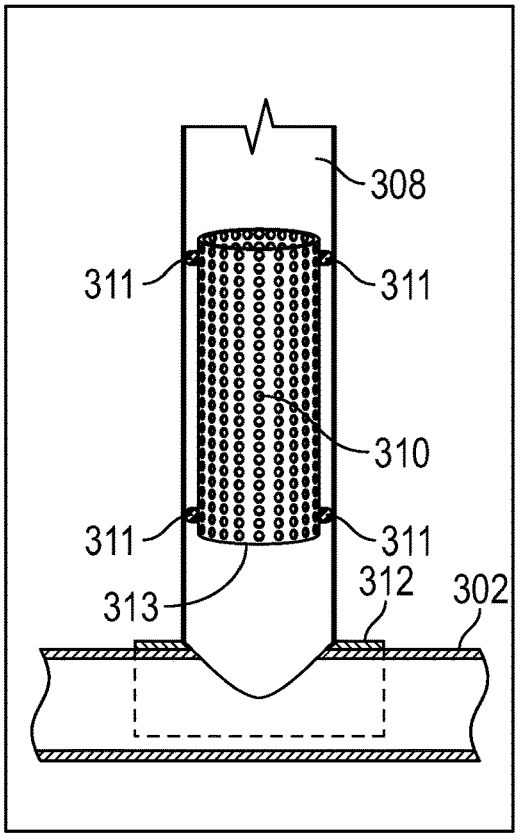
FIG. 9B is a cross sectional view taken along line 9B-9B in FIG. 9A.

FIGS. 9A-9B are pictorial representations of a filter assembly 313 for use with a collection pipe 308. As set forth herein, each collection pipe 308 includes a plurality of perforations 310 configured for water to pass through into the drainage pipe 302 (image on the left side of the drainage pipe 302. The collection pipe 308 is operably secured to the drainage pipe 302 by a pipe attachment 312. The image on the right (a sectional view of the image on the left side) of the drainage pipe 302 pictorially illustrates the filter assembly 313 within the collection pipe 308. The filter assembly 313 includes a plurality of perforations 310 through which water passes into the drainage pipe 302. The perforations 310 in the filter assembly 313 are smaller than the perforations in the collection pipe 308 to provide a filtering, screening, and/or separation of the water passing into the drainage pipe 302. The size of the perforations 310 in the filtering assembly 313 can be sized relative to the perforations in the collection pipe 308 to achieve a desired level of filtering. One or more gasket members 311 can be operably positioned between the inner wall of the collection pipe 308 and the filter assembly to secure the filter assembly 313 in place and relative to the inner wall of the collection pipe 308. The one or more gaskets 311 seal the interface between the inner wall of the collection pipe 308 and the filter assembly 313.

Figure 10:
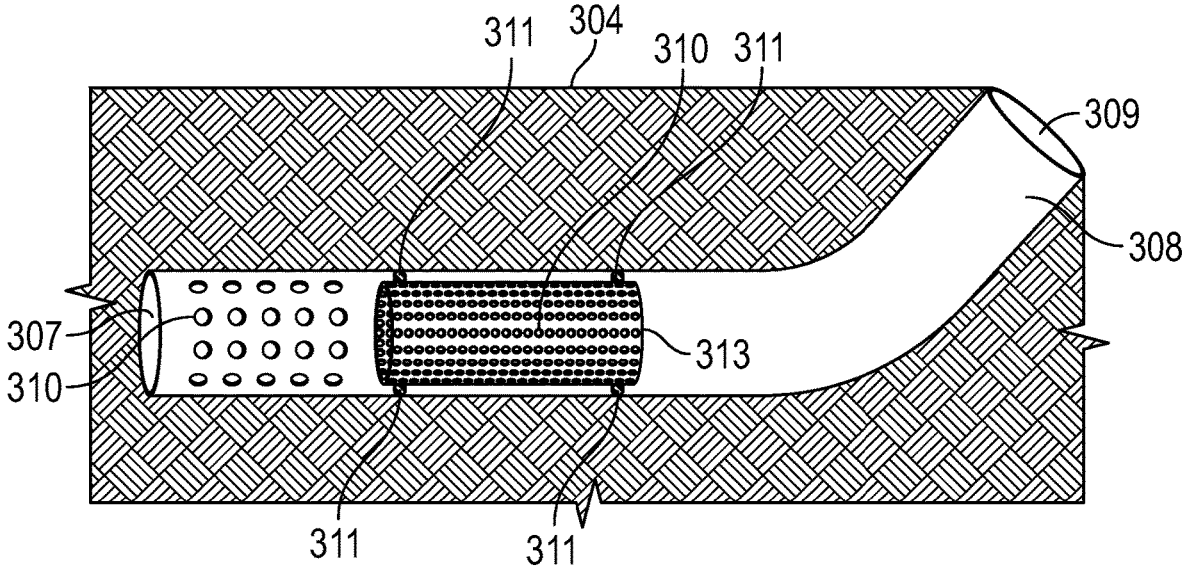
FIG. 10 is a pictorial representation of a filtering assembly for a collector system in accordance with another illustrative embodiment.

FIG. 10 is a pictorial representation of the collection and drainage pipe system 300. The system includes a collection pipe 308 having an access point 309 and a discharge point 307. The collection pipe is installed horizontally at a drainage area 304. Water passes from the surrounding area into the plurality of perforations 310 in the wall of the collection pipe 308 as described herein. A filter assembly 313 is disposed within the collection pipe 308 at the perforations 310 (perforations in the collection pipe 308 hidden on the right to show details of filter assembly 313 within collection pipe 308). The filter assembly 313 includes a plurality of perforations 310 through which water passes into the drainage pipe 302. The perforations 310 in the filter assembly 313 are smaller than the perforations in the collection pipe 308 to provide a filtering, screening, and/or separation of the water passing into the drainage pipe 302. The size of the perforations 310 in the filtering assembly 313 can be sized relative to the perforations in the collection pipe 308 to achieve a desired level of filtering. One or more gasket members 311 can be operably positioned between the inner wall of the collection pipe 308 and the filter assembly to secure the filter assembly 313 in place and relative to the inner wall of the collection pipe 308. The one or more gaskets 311 seal the interface between the inner wall of the collection pipe 308 and the filter assembly 313.

A collection and drainage pipe system 300 of the present disclosure could also be configured by trenchless operation at locations wrought with seasonal flooding and excess surface water flows. The present disclosure also contemplates that existing sewer and/or storm drainage systems, such as those with additional capacity, could be retrofitted with one or more collection pipes 308. For example, using methods of the present disclosure, one or more collection pipes 308 can be installed at a drawdown point 306 and connected with a gravity drain pipe that is part of an existing sewer system and/or storm drain system to remediate extraneous, nuisance and/or uncontrolled surface and subsurface fluid flows at the target collection and drainage area 304. Other aspects of the present disclosure contemplate adjusting a height and/or position of the plurality of perforations 310 on the collection pipe 310 for configuring the collection pipe 310 to capture fluid at a desired hydrostatic level underground at the target collection and drainage area 304.

The present disclosure is not to be limited to the particular embodiments described herein. In particular, the present disclosure contemplates numerous variations in the type of ways in which embodiments of the disclosure can be applied to a trenchless collector, method and system for capturing and draining off subsurface and/or surface fluid from a target collection and drainage area. The foregoing description has been presented for purposes of illustration and description. It is not intended to be an exhaustive list or limit any of the disclosure to the precise forms disclosed. It is contemplated that other alternatives or exemplary aspects are considered included in the disclosure. The description is merely examples of embodiments, processes or methods of the disclosure. It is understood that any other modifications, substitutions, and/or additions can be made, which are within the intended spirit and scope of the disclosure. For the foregoing, it can be seen that the disclosure accomplishes at least all of the intended objectives. Features, elements, functions and descriptions of each embodiment are not limited to any single embodiment and are thereby applicable across each and any one disclosed embodiment.

The previous detailed description is of a small number of embodiments for implementing the disclosure and is not intended to be limiting in scope. The following claims set forth a number of the embodiments of the disclosure disclosed with greater particularity.

What is claimed is:

1. A groundwater collection and drainage pipe system configured to direct surface fluids and subsurface fluids from a targeted fluids collection area to a designated drainage location, the groundwater collection and drainage system comprising:

a horizontal groundwater drainage pipe having an elongated cylindrical wall disposed underground at the targeted fluids collection area and within a horizontally drilled hole, the horizontal groundwater drainage pipe comprising:

a first end opposing a discharge end terminating at an opening disposed at the designated drainage location for discharging fluids, a drainage length extending between the first end and the discharge end and through the horizontally drilled hole at the targeted fluids collection area, the horizontal groundwater drainage pipe is detectable underground without excavation of a surface of the targeted fluids collection area, the horizontal groundwater drainage pipe installed without excavating the collection surface;

a detector for detecting the installed horizontal groundwater drainage pipe at the targeted fluids collection area;

an underground location of the installed horizontal groundwater drainage pipe acquired with the detector;

a drawdown point at the targeted fluids collection area, the drawdown point corresponding with the surface and subsurface fluids at the targeted fluids collection area and the detected location of the installed horizontal groundwater drainage pipe;

a vertical groundwater collection pipe comprising:

an elongated cylindrical wall with a vented cylindrical upper end disposed at the collection surface and an opposing cylindrical lower end disposed at the installed horizontal groundwater drainage pipe;

a pipe saddle having an upper attachment end secured to the lower end of the vertical groundwater collection pipe and a lower attachment end secured to the elongated cylindrical wall of the installed horizontal groundwater drainage pipe after installation of the vertical collection pipe; and a plurality of perforations in the elongated cylindrical wall of the vertical groundwater collection pipe for surface fluids and subsurface fluids to enter the vertical groundwater collection pipe from the targeted fluids collection area for discharging from the installed horizontal groundwater drainage pipe at the designated drainage location, a height of the plurality of perforations at the drawdown point for collection of the surface fluids and subsurface fluids, wherein the height of the plurality of perforations lowers the drawdown point and control a groundwater level;

an internal adjustable sleeve for isolating the plurality of perforations in the elongated cylindrical wall of the vertical groundwater collection pipe, wherein the internal adjustable sleeve is configured to open or close at least one of the plurality of perforations in the elongated cylindrical wall to control the groundwater level, wherein when the internal adjustable sleeve closes at least one of the plurality of perforations, fluid is prevented from entering the at least one of the plurality of perforations, wherein the adjustable sleeve is configured to raise or lower the groundwater level; and a reusable cylindrical filter disposed inside an interior of the elongated cylindrical wall of the vertical groundwater collection pipe adjacent the plurality of perforations, the reusable filter having a diameter smaller than a diameter of the vertical groundwater collection pipe and wherein the reusable cylindrical filter prevents soil from entering the interior of the elongated cylindrical wall of the vertical groundwater collection pipe.

2. The groundwater collection and drainage pipe system of claim 1, wherein the horizontal groundwater drainage pipe is installed at the targeted fluids collection area without excavation by horizontal directional drilling.

3. The groundwater collection and drainage pipe system of claim 1, further comprising:

a vent disposed in the opening of the vertical groundwater collection pipe at the surface for venting the vertical groundwater collection pipe to atmosphere.

4. The groundwater collection and drainage pipe system of claim 1, further comprising:

a hole disposed in the cylindrical wall of the installed horizontal groundwater drainage pipe at the pipe saddle, wherein the surface and subsurface fluids pass from the vertical collection pipe through the hole into the installed horizontal groundwater drainage pipe.

5. The groundwater collection and drainage pipe system of claim 1, wherein the plurality of perforations are in-situ created in the elongated cylindrical wall of the vertical groundwater collection pipe through the vertical borehole.

6. The groundwater collection and drainage pipe system of claim 1, wherein a bottom of the reusable filter disposed inside the elongated cylindrical wall of the vertical groundwater collection pipe comprises a gasket and wherein the gasket is configured to form a watertight seal.

7. The groundwater collection and drainage pipe system of claim 1, wherein a drawdown elevation of subsurface liquid corresponds to the depth of the plurality of perforations along the elongated cylindrical wall of the vertical groundwater collection pipe.

8. A fluids collection apparatus configured to direct surface fluids and subsurface fluids from a targeted fluids collection area to a designated drainage location, the fluids collection apparatus comprising:

a horizontal directionally drilled drain pipe previously installed at the targeted fluids collection area, the drain pipe having a discharge end terminating at the designated drainage location;

a drawdown point at a surface of the targeted fluids collection area, the drawdown point corresponding to the previously installed drain pipe;

a borehole at the drawdown point, the borehole extending from the drawdown point at a surface to the previously installed drain pipe;

a collection pipe having a cylindrical wall terminating at an upper end and lower end, the lower end of the collection pipe disposed within the borehole at the installed drain pipe and the upper end of the collection pipe disposed at the surface of the borehole;

a plurality of perforations disposed in the cylindrical wall for fluids to pass through and into the collection pipe, a first height of the plurality of perforations controlling a groundwater level;

an adjustable sleeve disposed within a cylindrical interior wall of the collection pipe and adjacent the plurality of perforations, the adjustable sleeve having a non-porous cylindrical profile approximating the cylindrical interior wall of the collection pipe, wherein the adjustable sleeve has at least one position that occludes a portion of the plurality of perforations to prevent the fluids from entering the collection pipe at a second height of the plurality of perforations, wherein the occlusion of the portion of the plurality of perforations controls the groundwater level and the drawdown point;

a cone of depression surrounding the collection pipe created by the plurality of perforations lowering the groundwater level; the cone of depression is configured to be raised or lowered by the adjustable sleeve;

a cylindrical reusable filter disposed within the collection pipe adjacent the plurality of perforations, the reusable filter having a cylindrical profile with a diameter smaller than a diameter of the cylindrical wall of the collection pipe to prevent soil particles from entering the collection pipe;

a pipe attachment disposed in the borehole between the lower end of the collection pipe and the installed drain pipe for connecting the collection pipe to the installed drain pipe; and a vent disposed at the upper end of the collection pipe near the surface of the borehole for venting the collection pipe to atmosphere.

9. The fluids collection apparatus of claim 8, further comprising:

one or more gaskets operably disposed between the adjustable sleeve and an interior wall of the collection pipe for movement of the adjustable sleeve relative to the plurality of perforations.

10. The fluids collection apparatus of claim 8, further comprising:

an underground location of the installed drain pipe identified by detection.

11. The fluids collection apparatus of claim 8, further comprising:

a hole disposed in the installed drain pipe by access through the collection pipe.

12. A fluid collection system configured to direct surface fluids and subsurface fluids from a targeted fluids collection area to a designated drainage location, the fluid collection system comprising:

a horizontal drainage pipe disposed underground and within a horizontally drilled hole at a collection surface;

a plurality of cylindrical collection pipes, each of the cylindrical collection pipes comprising:

a cylindrical upper end disposed at the collection surface and an opposing cylindrical lower end disposed at the installed horizontal drainage pipe; and a pipe attachment secured to the lower end of the cylindrical collection pipe and the installed horizontal drainage pipe;

a plurality of perforations in an elongated cylindrical wall of the cylindrical collection pipe for surface fluids and subsurface fluids to enter the cylindrical collection pipe from the targeted fluids collection area for discharging from the installed horizontal drainage pipe at the designated drainage location, a height of the plurality of perforations controlling a groundwater level;

an internal adjustable sleeve for isolating the plurality of perforations in the elongated cylindrical wall of the cylindrical collection pipe, wherein the internal adjustable sleeve is configured to open or close at least one of the plurality of perforations in the elongated cylindrical wall to control the groundwater level, wherein when the internal adjustable sleeve closes at least one of the plurality of perforations, fluid is prevented from entering the at least one of the plurality of perforations, wherein the adjustable sleeve is configured to raise or lower the groundwater level; and a reusable cylindrical filter disposed inside an interior of the elongated cylindrical wall of the vertical groundwater collection pipe adjacent the plurality of perforations, the reusable filter having a diameter smaller than a diameter of the cylindrical collection pipe and wherein the reusable cylindrical filter prevents soil from entering the interior of the elongated cylindrical wall of the cylindrical collection pipe.

13. The fluid collection system of claim 12, further comprising:

a portion of the cylindrical collection pipe of each of the plurality of cylindrical collection pipes having a non-porous cylindrical wall opposing the portion of the collection pipe having the plurality of perforations.

14. The fluid collection system of claim 12, wherein the plurality of perforations are created in the cylindrical collection pipe through a vertical borehole.

15. The fluid collection system of claim 12, further comprising:

a vent disposed in the opening of each of the plurality of cylindrical collection pipes at the surface for venting the cylindrical collection pipe to atmosphere.

16. The fluid collection system of claim 12, further comprising:

a hole disposed in the cylindrical wall of the installed horizontal drainage pipe by access at an opening of the lower end of the cylindrical collection pipe for fluids to pass into the installed horizontal drainage pipe from the collection pipe.

17. The fluid collection system of claim 12, further comprising:

a collection end at the first end of the installed horizontal drainage pipe disposed at the targeted fluids collection area.

* * * * *